US006006903A

United States Patent [19]

Milone

[11] Patent Number: 6,006,903

[45] Date of Patent: Dec. 28, 1999

[54] CIGAR HUMIDOR

[75] Inventor: Henry S. Milone, New York, N.Y.

[73] Assignee: Cigar Savors Enterprises LLC, Woodbridge, Conn.

[21] Appl. No.: 09/126,566

[22] Filed: Jul. 30, 1998

[51] Int. Cl.[6] ..... B65D 69/00; A24F 15/00

[52] U.S. Cl. ..... 206/204; 206/242; 312/271; 312/31.3

[58] Field of Search ..... 206/236, 242, 206/213.1, 204, 205; 312/31.3, 31.01, 31, 31.04, 273, 271, 305, 308, 309, 310, 311, 293.2

[56] References Cited

U.S. PATENT DOCUMENTS

| | | | |
|---|---|---|---|
| D. 372,138 | 7/1996 | Pasquale et al. . | |
| 1,016,492 | 2/1912 | Gunn | 206/205 |
| 1,586,938 | 6/1926 | Allen | 312/31.1 |
| 1,683,851 | 9/1928 | Wells | 206/236 |
| 2,058,800 | 10/1936 | Jasper | 206/205 |
| 2,333,831 | 11/1943 | Topjian | 206/242 |
| 2,343,193 | 2/1944 | Lathrop | 206/242 |
| 4,008,930 | 2/1977 | Swainson . | |
| 4,534,369 | 8/1985 | Jenkins . | |
| 5,011,009 | 4/1991 | Scheurer . | |
| 5,607,051 | 3/1997 | Espinosa . | |
| 5,794,771 | 8/1998 | Krawee et al. | 206/236 |
| 5,850,839 | 12/1998 | Adami | 206/242 |

OTHER PUBLICATIONS

Cu Avana™ Brochure "Creates and Preserves the Finest Cigars" brochure of Cu–Avana, Inc. (1997).

*Primary Examiner*—Bryon P. Gehman
*Assistant Examiner*—Jila Mohandesi
*Attorney, Agent, or Firm*—DeLio & Peterson LLC

[57] ABSTRACT

A cigar humidor is provided which effectively and conveniently humidifies cigars. The cigar humidor is preferably a square box-like shape which is bisected at diametrically opposed corners into two equal half sections. The humidor is hinged along one corner and closed along the diametrically opposed corner preferably by magnets. A support for vertically holding the cigars is attached at the hinged corner exposing all the cigars for easy accessibility when the humidor is opened by spreading apart the hinged sections. Humidifying means is provided below the lower end of the cigars and rising humid air contacts the lower end of the cigars which are supported in the humidor. The cigar support preferably has a slidable drawer at the lower end thereof to hold the humidifying means. The cigars rest in through holes which holes communicate with the humidifying means.

6 Claims, 7 Drawing Sheets

CIGAR HUMIDOR

BACKGROUND OF THE INVENTION

1. Field of the Invention

The present invention is directed to cigar humidors in general and, in particular, to a cigar humidor having two sections which when mated form a box or cube shape and which sections are vertical hinged together along one corner for opening the humidor by spreading the two sections apart and wherein cigars are vertically positioned in a cigar support therein and exposed to humidified air traveling upward from a humidifier device positioned at the bottom of the humidor.

2. Description of Related Art

Cigar humidors are essentially sealed storage containers which attempt to maintain a more-or-less constant humidity to the environment in which the cigars are stored and isolated from the environment outside the storage container which often changes with temperature and season. Ideally, such humidors maintain the relative humidity in the range of about 65 to 75 percent. In order to control such humidity, there may be placed within the humidor a water or moisture-containing device which releases water vapor within the container from the top of the container. Such humidors also have wood lining, such as cedar, which impart an aroma or flavor to the cigars. Exemplary humidors are found in U.S. Pat. Nos. 4,008,930, 4,534,369, 5,011,009 and 5,607,051, as well as U.S. Design Pat. No. 372,138.

Cigars are usually stacked several layers high on their sides within a humidor and the environment which each individual cigar sees is typically not uniform, i.e., only those cigars directly adjacent the side and upper walls of the humidor will receive the benefits of the moisture and wood aroma. In order to promote uniformity of circulation of moist air within the humidor, there has been proposed liners or separators having grooves or openings therein to increase the surface area of the liner and to increase the circulation of air within the humidor. While such liners and separators work satisfactorily, the humidification of cigars in such humidors is not very effective.

Bearing in mind the problems and deficiencies of the prior art, it is therefore an object of the present invention to provide a cigar humidor which effectively and uniformly humidifies all the cigars stored in the humidor.

It is another object of the present invention to provide a cigar humidor in which the cigars are stored vertically and wherein an end of the cigar, preferably the end to be lit, is directly exposed to humidified air traveling upward in the humidor.

A further object of the invention is to provide a cigar humidor wherein the cigars may be stored vertically and effectively and uniformly humidified and wherein the cigar humidor may be easily opened for access to the cigars and/or to add water to a humidifying device within the humidor.

It is yet another object of the present invention to provide a method for humidifying cigars in a cigar humidor.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a cigar humidor comprising:

an openable container having an upper end and a lower end for holding a plurality of cigars in a substantially vertical position, the cigars having an end which is to be lit and end which is placed in a smoker's mouth;

support means to hold the cigars in the substantially vertical position above the lower end of the container;

humidifying means positioned at the lower end of the container below the bottom of the support means so that humidified air travels upward in the container from the humidifying means and contacts the end of the cigar positioned downward in the humidifier, preferably the end to be lit, and preferably passes along the sides of the vertically positioned cigars as the humidified air travels upward in the humidor.

In another aspect of the present invention, a cigar humidor is provided comprising:

an openable container having a lower end and an upper end for holding a plurality of cigars in a substantially vertical position, the cigars having an end which is to be lit and an end to be placed in a smoker's mouth, the container having a pair of sidewall and top sections which sections are hinged together vertically along one edge of each of the sidewall sections with the free end of each section having a sidewall edge and a top edge which when said edges are mated forms a closed container when the base of the container is positioned on a surface;

a cigar support attached to a side wall section and preferably pivotally supported at the hinge for supporting a plurality of cigars in a substantially vertical position and the downward end of the cigars being above the lower end of the container; and humidifying means positioned at the lower end of the container below the bottom of the cigar support and the lower end of the cigars and preferably integral with the cigar support so that humidified air from the humidifying means travels upward in the container and contacts the end of the cigar which is positioned downward in the humidor and preferably passes along the sides of the vertically positioned cigars as the humidified air travels upward.

In another aspect of the invention, a cigar humidor is provided comprising:

an openable container having a lower end and an upper end for holding a plurality of cigars in a substantially vertical position, the cigars having an end to be lit and an end to be placed in a smoker's mouth, the container having a pair of triangular shaped sidewall sections with an integral top with the sidewall sections vertically hinged together along one edge of each of the sections with the free end of each section having a sidewall edge and a top edge which when said edges are mated forms a closed rectangular container preferably a square or cube when the base of the container is positioned on a surface;

a cigar support pivotally attached to the hinge for supporting a plurality of cigars in a substantially vertical position the end of the downwardly positioned cigars being above the lower end of the container; and humidifying means positioned at the lower end of the container, below the bottom of the cigar support and pivotally attached at the hinge and preferably an integral part of the cigar support so that humidified air travels upward in the container from the humidifying means and contacts the end of the cigar positioned downward in the humidor and preferably passes along the sides of the vertically positioned cigars as the humidified air travels upward.

In another aspect of the invention, the cigar humidor is the shape of a cube or box having an open bottom end. The cube shape is bisected along a diagonal line into two sections, each section having two sidewalls and an integral top. Each section is hinged together along a sidewall of each section with the free ends of the sidewalls forming a sidewall edge and a top edge. When the edges are mated, the cigar humidor is closed and a cube is formed. A cigar support is pivotally attached at the hinge and is in a grid form to support a plurality of cigars in a substantially vertical position above the lower end of the container. Humidifying means are provided at the lower end of the humidor preferably at the lower end of the cigar support and is preferably in the form of a drawer in the cigar support in which a humidifying means in positioned below the lower end of the cigars vertically positioned in the cigar support. The base of the cigar support forms the bottom end of the cube and provides a closed structure when the sidewall edges and top edges are mated. Magnets are preferably used to keep the two sections mated when the humidor is closed.

In a further aspect of the invention, the cigar support used in the cigar humidor has a plurality of openings at the lower end thereof on which the cigars rest and which openings are smaller than the diameter of the cigar and which openings communicate with the humidifying means. In a preferred embodiment of the invention, the openings at the bottom of the cigar support are in the shape of a taper with the smaller diameter at the lower end of the taper so that the cigar fits part way within the opening.

In a further aspect of the invention, a method is provided for humidifying cigars in a cigar humidor using the cigar humidor described above. The method comprises supplying a cigar humidor as described above; adding water to the humidifying means, if necessary; stacking cigars in the cigar support; and closing the humidor.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT

Figure 1:
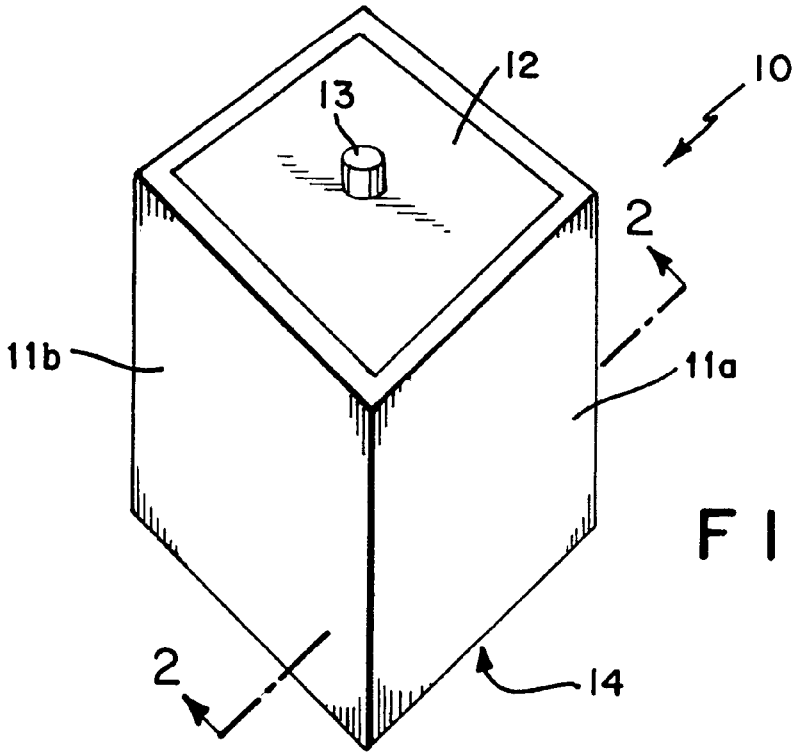
FIG. 1 is a perspective view of a cigar humidor of the invention.

In describing the preferred embodiment of the present invention, reference will be made herein to FIGS. 1–10 of the drawings in which like numerals refer to like features of the invention. Features of the invention are not necessarily shown to scale in the drawings.

A cigar humidor of the invention is shown generally as 10 in FIG. 1. The cigar humidor 10 is essentially a rectangular (square) box having side walls 11*a*, 11*b* (and 11*c* and 11*d* not shown). The humidor 10 has a base 14, although for other designs discussed hereinbelow, a base is preferably supplied by a support used to support the cigars and a humidifier device. At the top of the humidor 10 is a cover 12 having a handle 13 for removal of the top 12 from the humidor when a cigar is desired, to place more cigars therein or to service the humidifier means. The humidor 10 is basically an open box having a cover 12. The humidor 10 may also be cylindrical or any other convenient shape for storing cigars in a vertical position.

Figure 2:
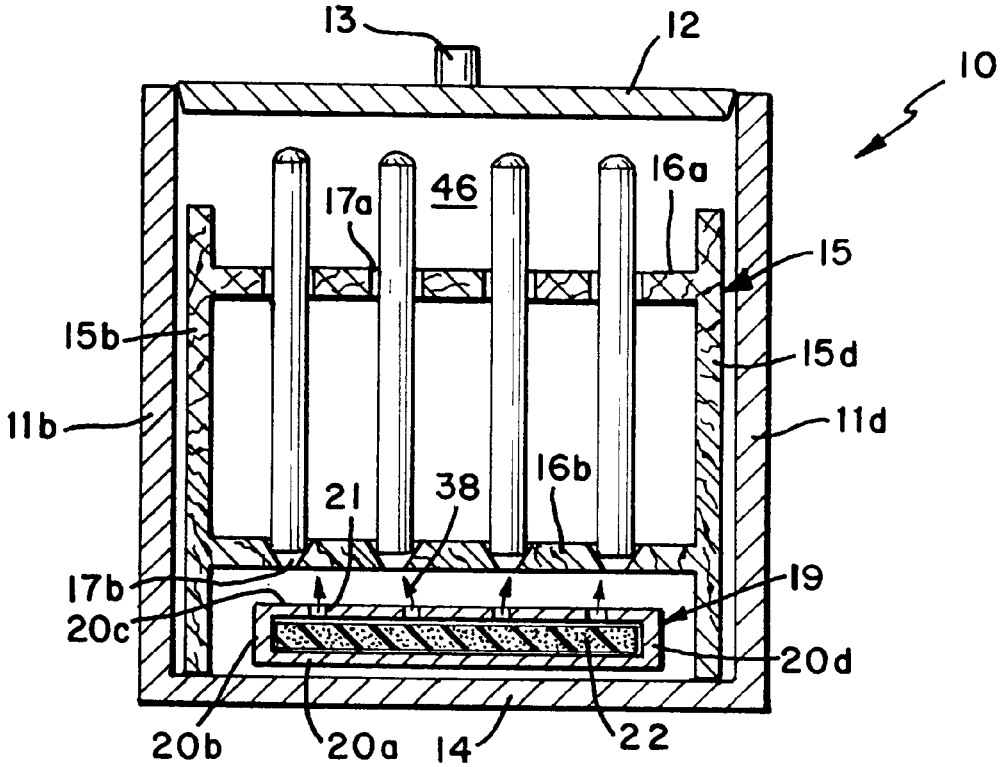
FIG. 2 is a cross-sectional view along the lines 2—2 of FIG. 1 showing a cigar support and humidifying device positioned on the cigar humidor.

Referring now to FIG. 2, a cross-sectional view of the humidor of FIG. 1 is shown. Sidewalls 11*b* and 11*d* and base 14 define a compartment 46 in the humidor 10. Top 12 having handle 13 covers the opening of the cigar humidor. Positioned in the humidor is a cigar support shown generally as 15. The cigar support has vertical side wall members 15*b* and 15*d* which extend from the upper portion of the cigar humidor 10 and rests on base 14. The cigar support 15 has cross-members 16*a* and 16*b* having openings 17*a* and 17*b* therein for holding the cigars 18 in a substantially vertical position in the humidor. Cross-member 16*b* is positioned above base 14 so that a humidifying member 19 can be rested on base 14 below cross-member 16*b*. Humidifying member 19 has a base 20*a*, sidewalls 20*b* and 20*d* and a top 20*c* forming a closed container. The humidifying member 19 has openings 21 in the upper surface thereof and a sponge or other such material 22 for holding water is contained within the humidifying means 19. The openings 21 allow water vapor to escape upward in the humidor in the direction of the arrows 38.

As can be seen from FIG. 2, the cigars 18 are positioned vertically in the humidor 10 and are supported by and rest on openings 17*b* of cigar support 15. Openings 17*b* are preferably tapered downwardly so that the cigar rests in opening 17*b* intermediate the thickness of cross-member 16*b*. The water vapor 38 coming from humidifier 19 travels upward in the humidor directly at the end of the cigar 18 facing downward in the humidor. The end of the cigar to be lit is preferably positioned downward. This is an important feature of the invention as the moisture is directed at the end of the cigar and keeps the cigar totally humidified as compared with prior art practices of stacking the cigars horizontally in a humidor and humid air filling the humidor directed at the side of the cigars. The water vapor 38 contacts both the end of the cigars facing downward in the humidor and also travels upward along the sides of the cigars 18 providing a total humidification effect to the cigar. The cigar support is preferably made of wood, especially an aromatic wood such as cedar. Other holes may be in cross-member 16*b* to allow additional humid air to travel upward along the cigar sides.

Figure 3:
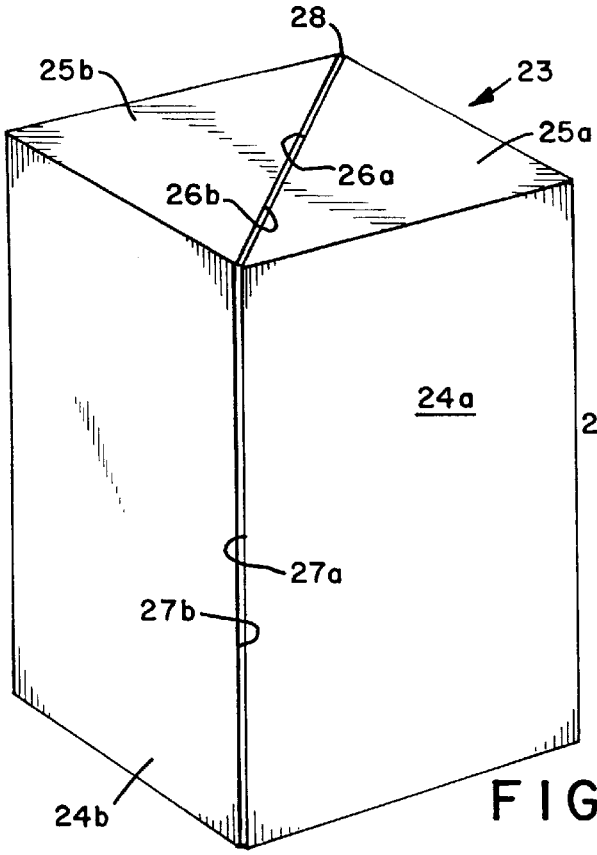
FIG. 3 is a perspective view of a preferred pivotally openable cigar humidor of the invention.

Referring now to FIG. 3, another cigar humidor of the invention is shown generally as 23. The humidor 23 is generally in a square cube-like shape having side walls 24*a* and 24*b* (and 24*c* and 24*d* not shown). The humidor 23 is divided in half diametrically forming top edges 26*a* and 26*b* and side wall edges 27*a* and 27*b*. The humidor 23 is closed at the top by integral covers 25*a* attached to sidewalls 24*a* and 24*d* and 25*b* attached to sidewalls 24*b* and 24*c*. In a preferred embodiment of the invention, the humidor 23 does not have a base and is open at the bottom. This will be more fully shown in the following figures. The humidor 28 is vertically hinged along corner 28 so that the humidor 23 may be opened by separating side walls 24*a* from 24*b* from each other as shown herein below. Magnets are preferably used on edges 26*a*, 26*b*, 27*a* and 27*b* to keep the humidifier closed. A latch or other locking device also can be used. The sidewalls and top may be made of any suitable material and such as wood or plastics, including clear plastic to allow viewing the stored cigars.

Figure 3A:
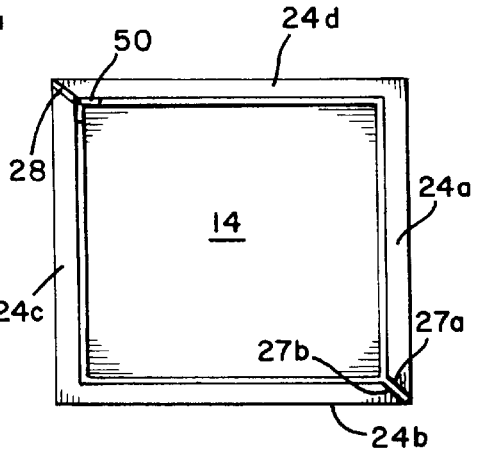
FIG. 3*a* is a bottom plan view of the cigar humidor of FIG. 3.

FIG. 3*a* shows the bottom 14 of the humidor 23, sidewalls 24*a–d*, corner 28 and hinge 50 which allows sidewalls 24*a* and 24*d* and 24*b* and 24*c* to pivot around corner 28 when opening the humidor.

Figure 4:
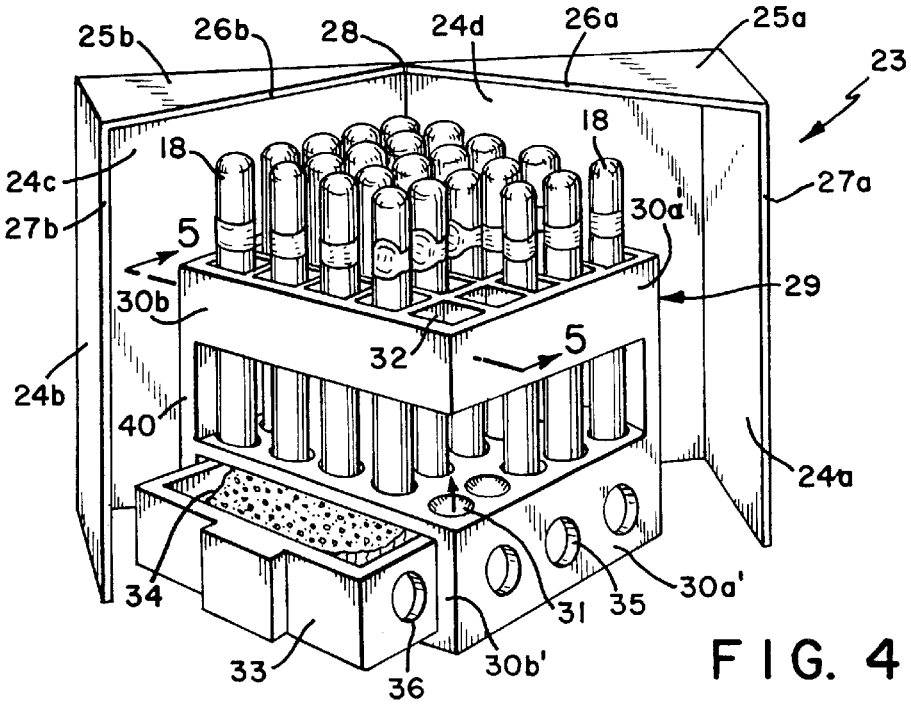
FIG. 4 is a perspective view of the cigar humidor of FIG. 3 in an open position.

FIG. 4 shows the cigar humidor 23 of FIG. 3 in an open position ready for removing or adding a cigar to the humidor, adding a humidifier device to the humidor or adding water to the humidifier device. Firstly, it will be noted that in the open position, as shown in FIG. 4, the cigars 18 are readily accessible and are stacked substantially vertically in a cigar holder shown generally as 29. As can be also seen from FIG. 4., the humidor 23 does not have a base but the base is formed by the bottom of cigar support 29 so that when the humidor 23 is in the opened or closed position, the humidor rests on the sidewalls 24*a*–24*d* of the humidor and on the base of the cigar support 29. It will be appreciated by those skilled in the art that a humidor can also be made having an integral (as with the top) base with the cigar support 29 being supported to the sidewalls or corner of the humidifier above the base of the humidor. The preferred humidor structure however is shown in FIG. 4. The cigar support may be made of any suitable material typically an aromatic wood such as cedar.

Referring now to FIG. 4 the humidor 23 is shown in an open position which was formed by pivoting sidewalls 24*a* and 24*b* (and connected sidewalls 24*c* and 24*d*) about pivot point 28 and hinge 50 (not shown) The rear corner of cigar support 29 is also attached to hinge 50 for support and pivoting. Accordingly, cigar support 29 is pivotable around hinge 50 but will typically remain stationary on the surface on which it was placed when the humidor 23 is opened by moving sidewall 24*a* and 24*b* to the open position as shown in FIG. 4.

Cigar support 29 is shown having an upper gridlike section 30*a* and 30*b*, and has openings 32 therein for insertion and holding of the cigar in a vertical position. The lower portion of cigar support 29 is formed by section 30*a*' and 30*b*'. The upper section 30*a* and 30*b* and lower section 30*a*' and 30*b*' are joined by sidewalls 40 and 44. The lower section 30*a*' of the cigar support 29 has openings 31 therein in line with grid openings 32 to hold the cigars 18 in a substantially vertical position. The holes 31 are preferably tapered as will be described hereinbelow.

A drawer 33 is provided in the lower section 30*b*' of the cigar support 29 holder which is slidable in and out of the lower section. The drawer holds humidifying means 34 which as described above is generally a flat device having openings at the upper end thereof for the emission of water vapor from a moistened material maintained within the humidifying device. Communicating openings 35 in the lower section 30*a*' and openings 36 in the drawer are used to circulate air in an out of the drawer.

Figure 5:
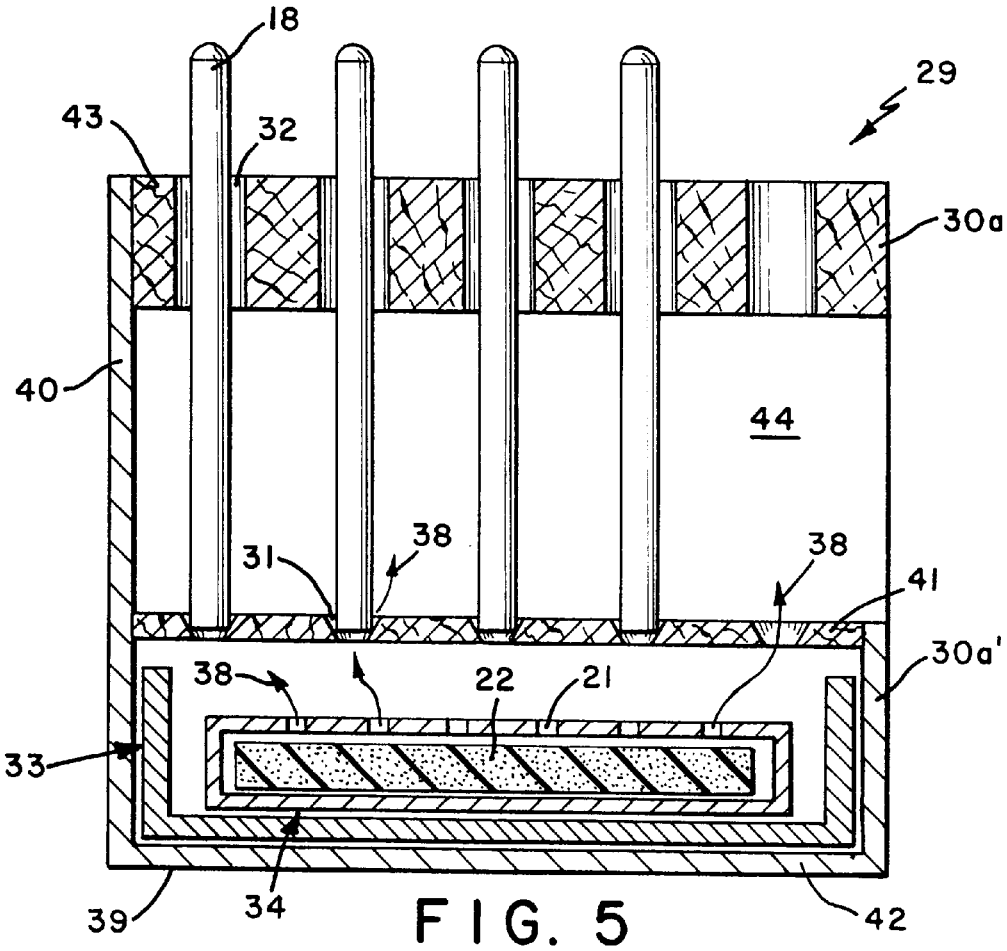
FIG. 5 is a cross-sectional view along lines 5—5 of FIG. 4.

Referring now to FIG. 5, a cross-sectional view of the cigar support 29 is shown. The cigar support has sections 30*a* and 30*a*' connected by walls 40 and 44 and a base 42. Horizontal members 43 and 41 have openings therein (32 and 31 respectively) for supporting the cigars 18. The holes 31 are generally tapered downwardly for support of the cigar in a position intermediate the thickness of the support member 41. Drawer 33 is shown carrying humidifying means 34. Water vapor 38 is emitted from humidifying means 34 through openings 21 and travels upward through the cigar support and contacts the end of cigar 18 supported in hole 31. This end of cigar is preferably the end of the cigar which is lit (typically called "feet") and this contact of the end of the cigar with humid air provides enhanced humidification of the cigar. Water vapor also travels upward through openings 31 along the sides of the cigar 18 providing total humidification of the cigar. Additional openings may be provided proximate the other openings, for additional air to travel upward along the sides of the cigars. The upward travel of water vapor 38 can also be seen when the humidor does not have a cigar in one of the openings 31 and 32. As described above, cigar support 29 is preferably hinged to the corner of the sidewalls forming the humidor so that the base 42 forms the bottom of the humidor structure.

Figure 6:
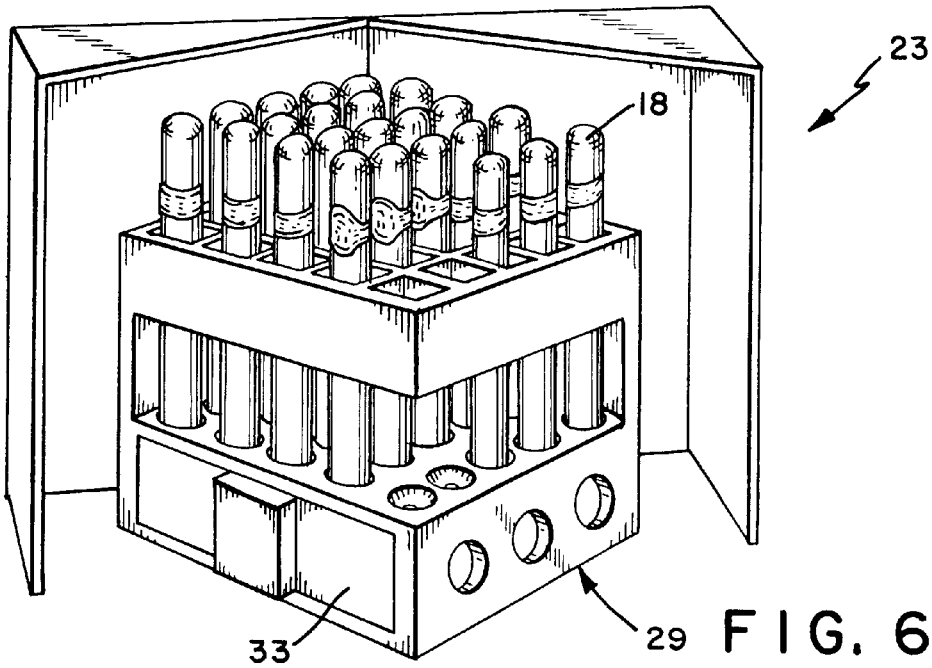
FIG. 6 is a perspective view of the cigar humidor of FIG. 3 in an open position with the drawer holding humidifying means closed.

FIG. 6 shows a preferred cigar humidor 23 of the invention in an open position so that the cigars 18 are readily accessible. A drawer 33 holding humidifying means is shown in the closed position in cigar support 29.

Figure 7:
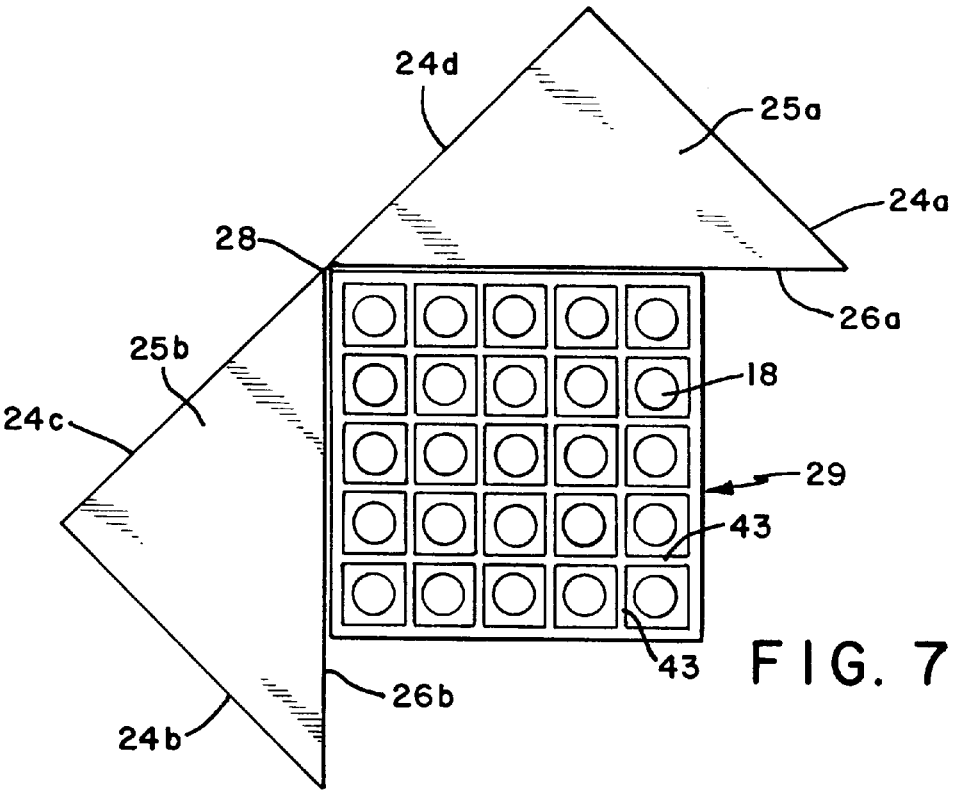
FIG. 7 is a top plan view of FIG. 6

FIG. 7 shows the open cigar humidor of FIG. 6 in a top plan view. Sidewalls 24*c* and 24*d* are hinged together at corner 28. Cigar support 29 is pivotally connected at corner 28. When the sections containing sidewalls 24(*b*) and 24(*c*) and 24(*d*) and 24(*a*) are rotated together, a closed cigar humidor is formed having a top formed by sections 25(*a*) and 25(*b*). A grid is formed by intersecting cross-members 43.

Figure 8:
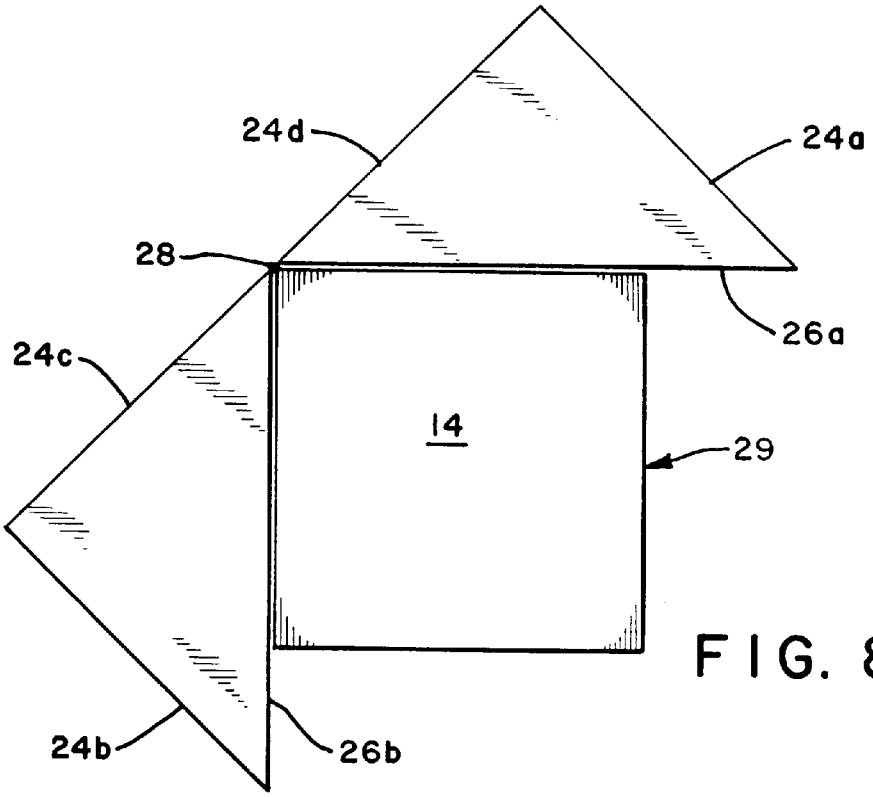
FIG. 8 is a bottom plan view of FIG. 6.

FIG. 8 shows a bottom plan view of the opened cigar humidor of FIG. 6.

Figure 9:
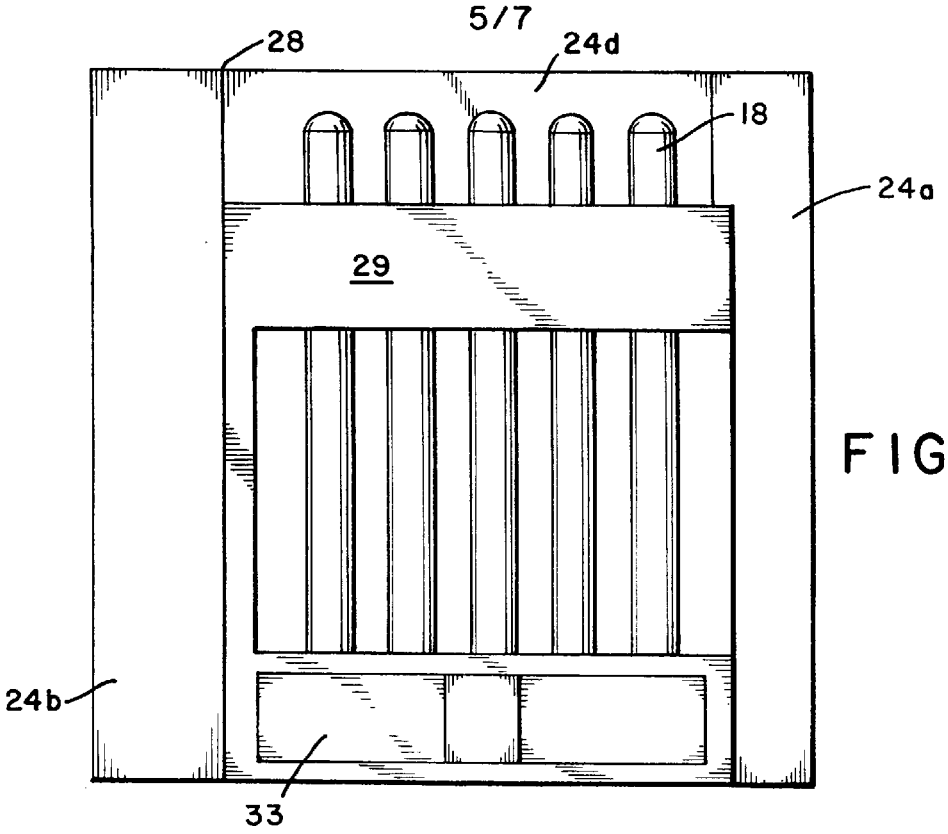
FIG. 9 is a side elevational view of FIG. 6.

FIG. 9 shows a side elevational view of the opened cigar humidor of FIG. 6 taken in the direction facing the drawer 33. Sidewalls 24*b*, 24*d* and 24*a* are shown forming an envelope around cigar support 29.

Figure 10:
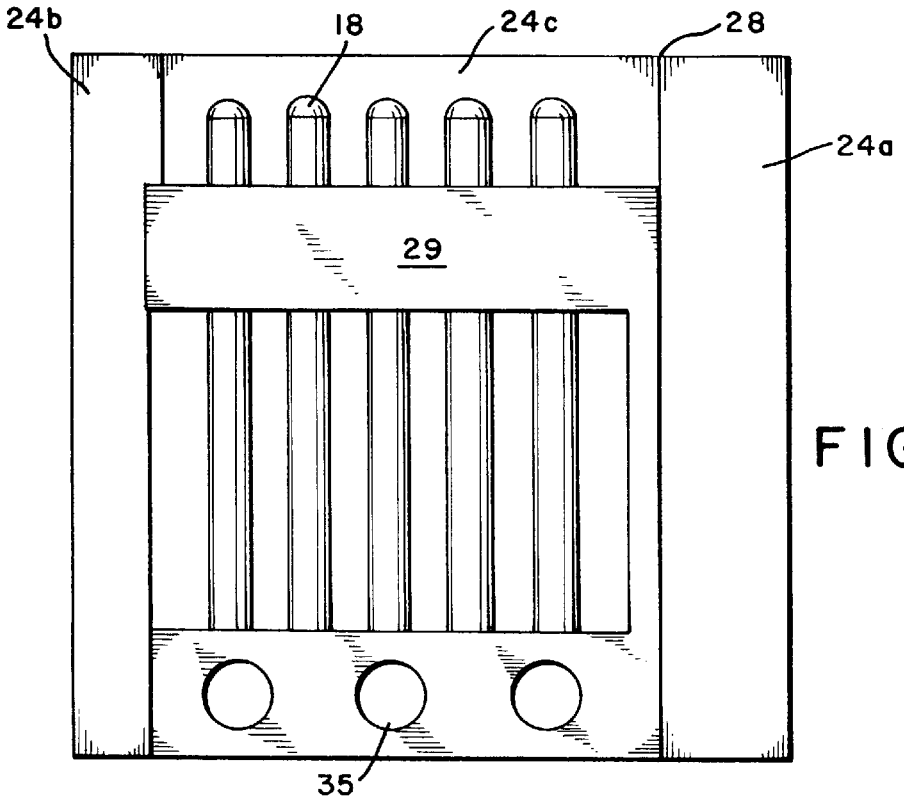
FIG. 10 is a side elevational view of FIG. 6.

FIG. 10 shows a side elevational view of the opened cigar humidor of FIG. 6 taken in the direction of openings 35 of cigar support 29. Sidewalls 24*b*, 24*c* and 24*a* are shown forming an envelope around cigar support 29.

Figure 11:
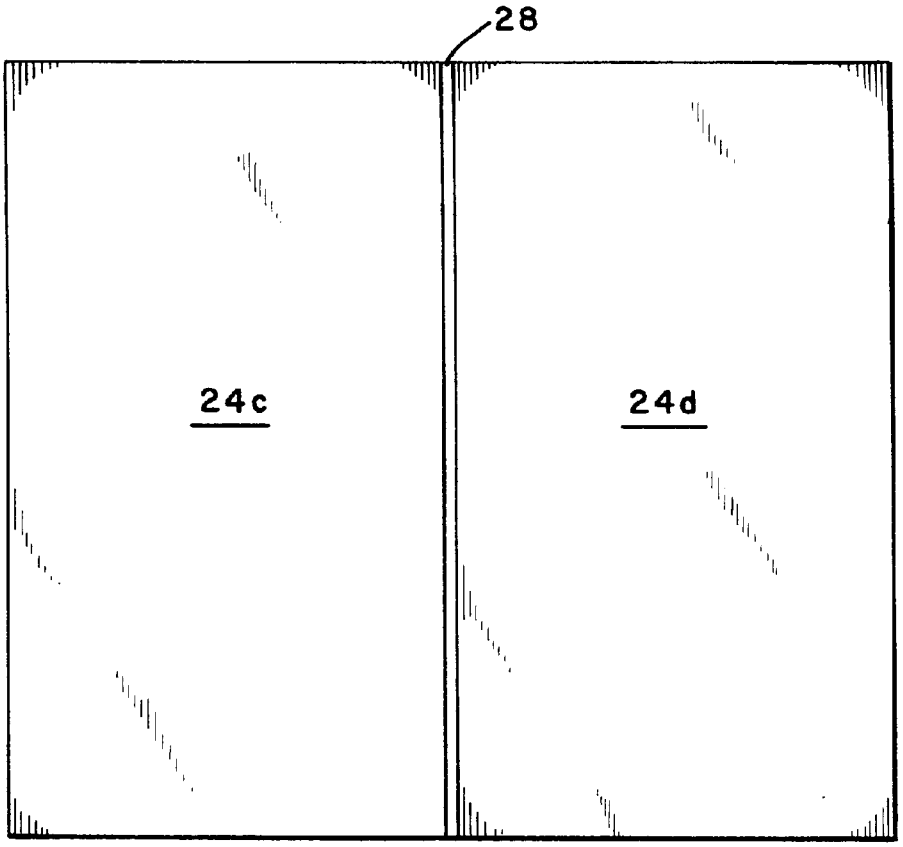
FIG. 11 is a rear elevational view of FIG. 6.

FIG. 11 shows a rear elevational view of the opened cigar humidor of FIG. 6. Sidewalls 24*c* and 24*d* are vertically hinged along corner 28.

Figure 12:
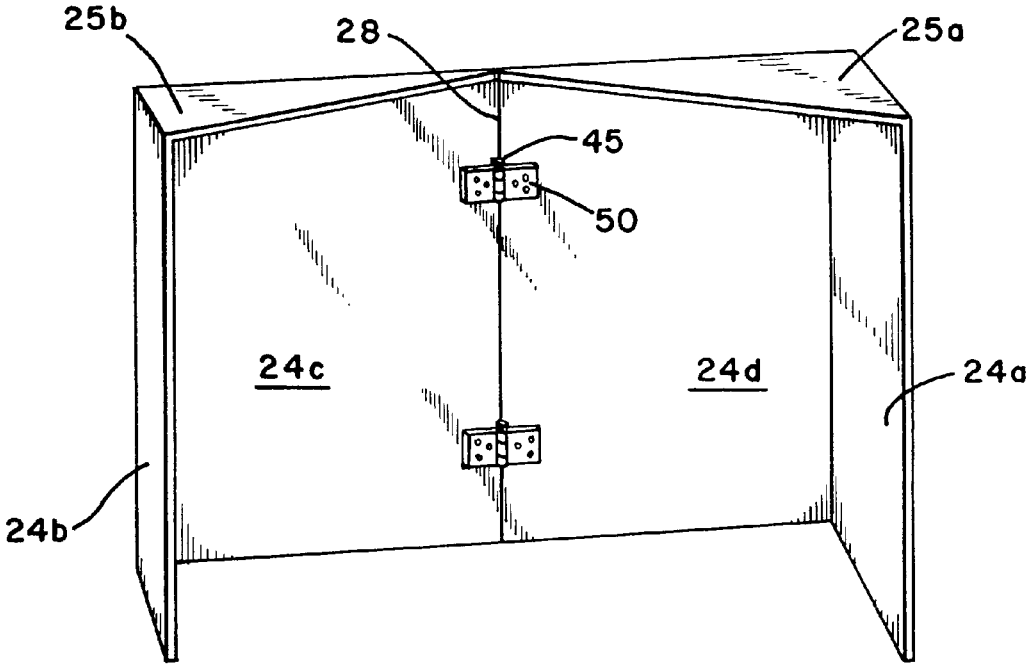
FIG. 12 is a perspective view of the cigar humidor of FIG. 6 without the cigar support 29.
Figure 13:
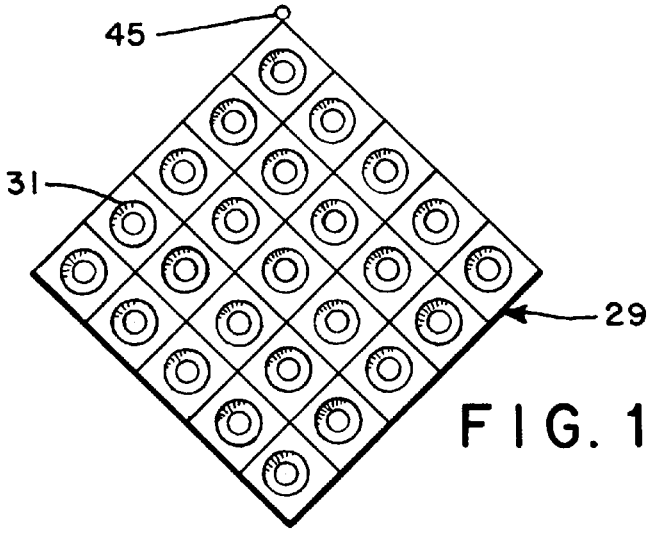
FIG. 13 is a top plan view of the cigar support shown in FIG. 6.

FIG. 12 shows the container of the cigar humidor as shown in FIG. 6 without the cigar support 29 structure. Sidewalls 24*a* and 24*d* are integrally joined with top 25*a*. Likewise sidewalls 24*b* and 24*c* are integrally joined with top 25*b*. At corner 28 the sidewall sections are pivotally joined by hinge 50 and hinge pin 45. FIG. 13 shows a plan view of cigar support 29 wherein pin 45 is secured to hinge 50 to provide for pivotal movement of cigar support 29 and to also attach the cigar support 29 to the corner container sidewalls. Other methods of attaching the cigar support to the corner or sidewalls could be used.

Figure 14:
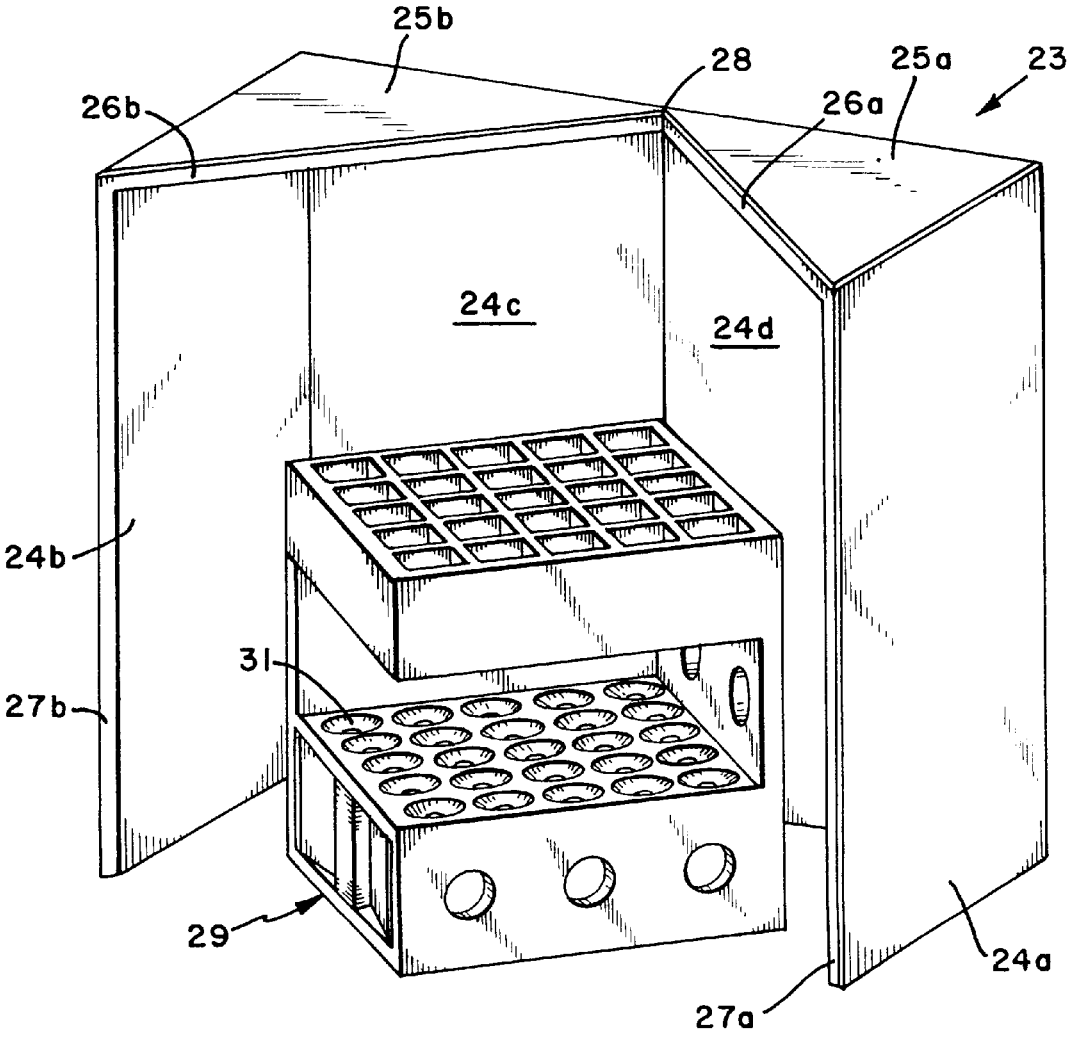
FIG. 14 is a perspective view of the cigar humidor shown in FIG. 6 without cigars being supported therein.

FIG. 14 is another view of the cigar humidor 23 wherein the cigar support 29 does not have any cigars inserted therein. The hinges pivotally holding the sidewall sections and cigar support are not shown since they are hidden behind the cigar support case.

Thus, having described the invention, what is claimed is:

1. A cigar humidor comprising:

an openable container having a lower end and an upper end and sidewalls for holding a plurality of cigars in a substantially vertical position, the cigars having an end which is to be lit and an end to be placed in a smoker's mouth, the container being vertically bisected forming a pair of mating sidewall and lower and upper end sections which sections are hinged together vertically along one mating edge of each of the sidewall sections with the free end of each section having a sidewall edge and a lower and upper end edge which when said edges are mated forms a closed container when the base of the container is positioned on a surface;

a cigar support pivotally supported at the hinged edges for supporting a plurality of cigars in a substantially vertical position in the container and the lower end of the cigars being supported by the cigar support above the lower end of the container forming a space between the lower end of the cigar and the lower end of the container; and humidifying means pivotally positioned at the hinged edges at the lower end of the container below the bottom of the cigar support and the lower end of the cigars so that humidified air from the humidifying means travels upward in the container and contacts the cigars which are positioned downward in the humidor.

2. The cigar humidor of claim 1 wherein the container is in the shape of a rectangular box.

3. The cigar humidor of claim 2 wherein the container is bisected vertically along the diagonal of the upper end and lower end.

4. The cigar humidor of claim 3 wherein the cigar holder is rectangular.

5. The cigar humidor of claim 4 wherein the cigar support has a plurality of openings to position and hold the cigars vertically therein with the openings being smaller at the lower end thereof so that the cigars rest in the openings above the lower end of the cigar humidor and which openings allow the humidified air to travel through from the humidifying means below the cigar support.

6. The cigar humidor of claim 5 wherein the cigar support has a drawer at the lower end thereof for holding the humidifying means below the lower end of the cigars.

* * * * *